United States Patent [19]

Biechler et al.

[11] Patent Number: 5,052,936

[45] Date of Patent: Oct. 1, 1991

[54] HIGH DENSITY ELECTRICAL CONNECTOR

[75] Inventors: Donald t. Biechler, Harrisburg; Warren C. Hillbish, Hummelstown; John W. Kaufman, Hershey, all of Pa.

[73] Assignee: AMP Incroporated, Harrisburg, Pa.

[21] Appl. No.: 604,836

[22] Filed: Oct. 26, 1990

[51] Int. Cl.[5] ..... H01R 9/09

[52] U.S. Cl. ..... 439/60; 439/260; 439/630; 439/636

[58] Field of Search ..... 439/60, 62, 64, 65, 439/260, 629, 630, 632, 636, 637

[56] References Cited

U.S. PATENT DOCUMENTS

| | | | |
|---|---|---|---|
| 4,598,966 | 7/1986 | Boland | 439/260 |
| 4,842,538 | 6/1989 | Noschese | 439/260 |
| 4,869,672 | 9/1989 | Andrews, Jr. | 439/60 |
| 4,955,820 | 9/1990 | Yamada et al. | 439/83 |

*Primary Examiner*—Paula A. Bradley

[57] ABSTRACT

An electrical connector assembly ( b 10) includes a connector (22) for interconnecting circuit boards such as a daughter board (12) to a mother board (102) wherein contact pads on the boards are on very small centers. Connector (22) includes a housing having an upper housing portion (24) and a pair of lower housing subassemblies (60), each subassembly including housing (62) having first and second contact members (74, 92) affixed thereto with the contact members having upper ends (78, 92) made to lie on a common plane and engage one side of a circuit board (12) inserted into the connector (22) in a resilient engagement therewith, anfd having lower ends which form solder tails (88, 96) held for soldering to pads (106, 108) on a mother board with such contact membrs being formed with the solder tails (88, 96) interdigitated to lie in a common row and a common plane on center spacings substantially less than center spacings of the upper ends.

9 Claims, 5 Drawing Sheets

12
18
20
Y
30
39
14
32
16
34
38
10
41
34
22
41
101
24
101
104
106
26
28
40
108
102
X
108
106
104
106

HIGH DENSITY ELECTRICAL CONNECTOR

This invention relates to a high density printed circuit board connector for use in interconnecting daughter boards to mother boards wherein the circuit paths are on very small centers.

BACKGROUND OF THE INVENTION

The trend to higher density electrical connectors has witnessed centerline spacings of in excess of 0.150 inches reduced to spacings half of that, then one-third of that and in many instances, one-sixth; or, on the order of 0.025 inches in certain mother board constructions. By this is meant that the conductive paths or pads on the surfaces of a board are spaced on centers on the order of 0.025 inches, typically in one or several rows on the edges of the board or in certain instances, in rows well within the periphery of the board. The trend to smaller centerline spacings is driven by a variety of technical advances, including the ability to build very complex electronic integrated circuits, indeed whole computer functions in a single integrated circuit that require, in certain instances, hundreds of conductive paths serving as inputs and outputs of the device to related components. A further technical reason for the trend has been the use of higher speed signals which function better with shorter path lengths but in turn require additional parallel grounding paths to maintain desirable impedances for signal transfer.

A significant problem associated with these trends has to do with the difficulty of manufacturing very small, fine electrical contacts and terminals, the difficulty of designing dies and stamping and forming such contacts along with the difficulty of molding housings having cavities small enough to accommodate such contacts on close centers.

U.S. Pat. No. 4,869,672 deals with a dual purpose card edge connector that has contact elements disposed in an insulating housing alternately located at two different levels which effectively doubles the number of circuit traces that can be accommodated in a given connector length. The connector of the patent is intended to accommodate daughter boards having contact paths on different centers but nevertheless teaches a certain construction which facilitates increasing the capacity of a connector to connect the paths of a daughter board to a mother board. In this patent, the contacts engaging the daughter board are arranged in two rows engaging each side of a daughter board and the contacts extend to be soldered into a mother board in two rows for each side of the daughter board in order to achieve the intended purpose of the connector. The connector construction of the aforementioned patent allows for an interconnection between daughter and mother boards of 0.025 inches for each linear inch of board engagement but the invention concept relies upon utilizing two rows for each side of a daughter board and four rows of contacts for the mother board.

The present invention, on the other hand, seeks to provide an interconnection between daughter and mother board essentially half of the foregoing with contact pads in a single row on a mother board being 0.025 inches apart.

SUMMARY OF THE INVENTION

The present invention facilitates interconnection of the contact paths of a daughter board to the conductive paths or pads on a mother board. The invention includes a housing which is affixed to the mother board and is slotted to receive a daughter board inserted therein and positioned precisely relatively to contact paths on the daughter board and on the mother board. The housing is comprised of three parts, including an upper part slotted to receive, position, and support a daughter card inserted therein and a plurality of lower parts which hold contact elements for sliding and resilient engagement with the daughter board while clamping opposite end portions of contacts in engagement with the conductive pads of the mother board. The upper housing latches to and traps and affixes the lower portions of the housing and latches the several housings together. The contacts of the connector extend upwardly into the upper part of a housing and are supported therein transversely or longitudinally of the housing within interior surfaces of such housing limiting movement of the contacts to assure alignment and preclude overstress. Each of the contacts has at the end opposite the resilient end a short, stiff solder tail portion which in use is soldered to a conductive pad on the mother board. In accordance with the invention, the contacts are arranged in rows on each side of the daughter board with pairs of contacts arranged one over the other to pick up and engage rows of contact pads on the daughter board, having a corresponding geometric arrangement of contact pads thereon. The contacts on each side of the mother board or of the connector are made to lie in essentially the same plane in both the longitudinal and transverse sense with the solder tab ends interdigitated by having the lower of the contacts offset. The solder tails are thus all arranged in a single row to contact conductive pads on the mother board lying in a single row. In accordance with the invention, the contact pads on the mother board may be on the order of 0.025 inches to provide for each linear inch of connector and effective center-to-center spacing of half of 0.025 inches, considering the two rows on the mother board for the given connector location.

It is an object of the present invention to provide a high density electrical connector for interconnecting the circuit paths of daughter boards carrying components to mother boards providing internal circuit interconnections for a variety of functional purposes.

It is a further object of the invention to provide a technique in the form of an electrical connector which reduces the surface area required for high density interconnections between printed circuit board.

It is still a further object of the invention to provide a connector for interconnecting circuit paths on a daughter board of a given center-to-center spacing to circuit paths on a mother board considerably reduced center-to-center spacings.

IN THE DRAWINGS

DETAILED DESCRIPTION OF THE INVENTION

Figure 1:
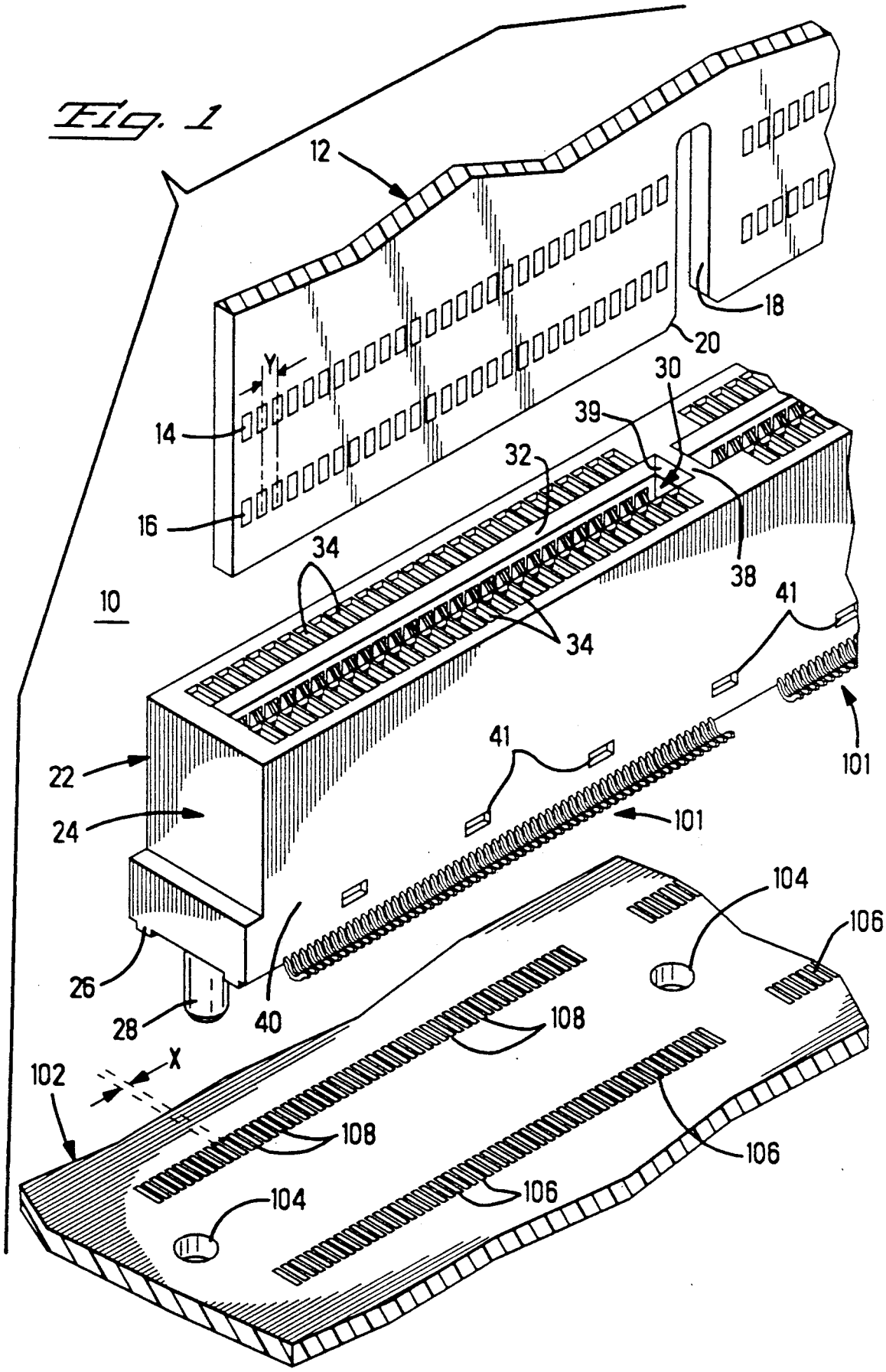
FIG. 1 is an exploded perspective view showing portions of a daughter board, a connector of the present invention and a mother board.
Figure 5:
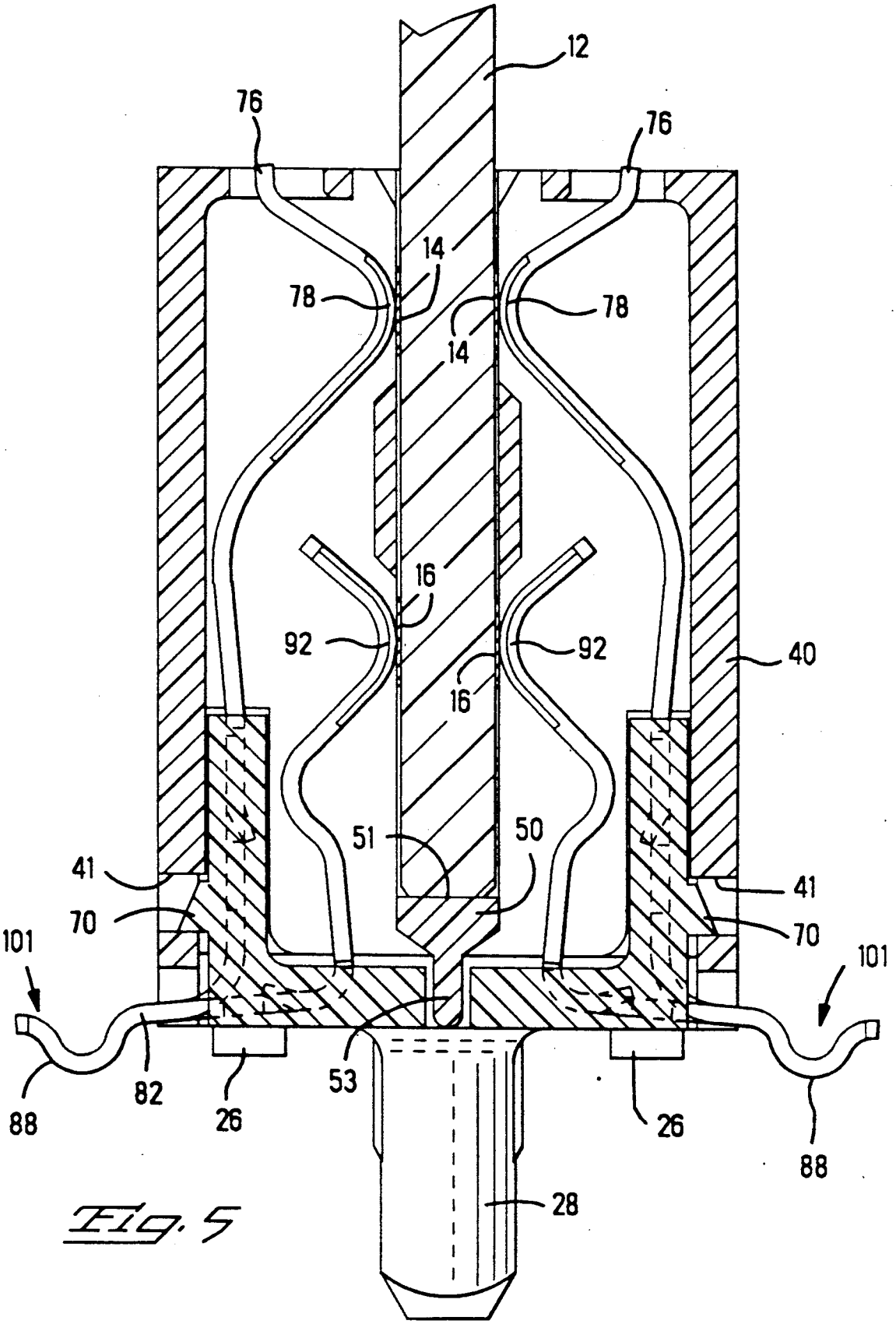
FIG. 5 is a view of the connector similar to that of FIG. 4 and further including a circuit board inserted into the connector.

Referring now to FIG. 1, an assembly 10 includes a daughter board 12, a connector 22, and a mother board 102 preparatory to assembly of the three elements and insertion of the daughter board within the connector. The daughter board depicted in FIG. 1 includes only a corner end and it is understood that such board would normally include components forming all or part of circuit functions for an electronic device or apparatus such as a computer, business machine, word processor, or the like. The board 12 includes on each major surface thereof first and second rows of contact paths or pads 14, 16 as shown in FIGS. 1 and 5. The other side of the board as shown in FIG. 5 includes similar pads 16. Toward the center of the board 12 is a slot 18 beveled at 20, which facilitates precise alignment of the pads 14 and 16 relative to contacts within connector 22. Board 12 frequently includes conductive traces on the surfaces thereof or embedded therein in laminations of etched copper foil and plastic film.

Figures 2A, 2B:
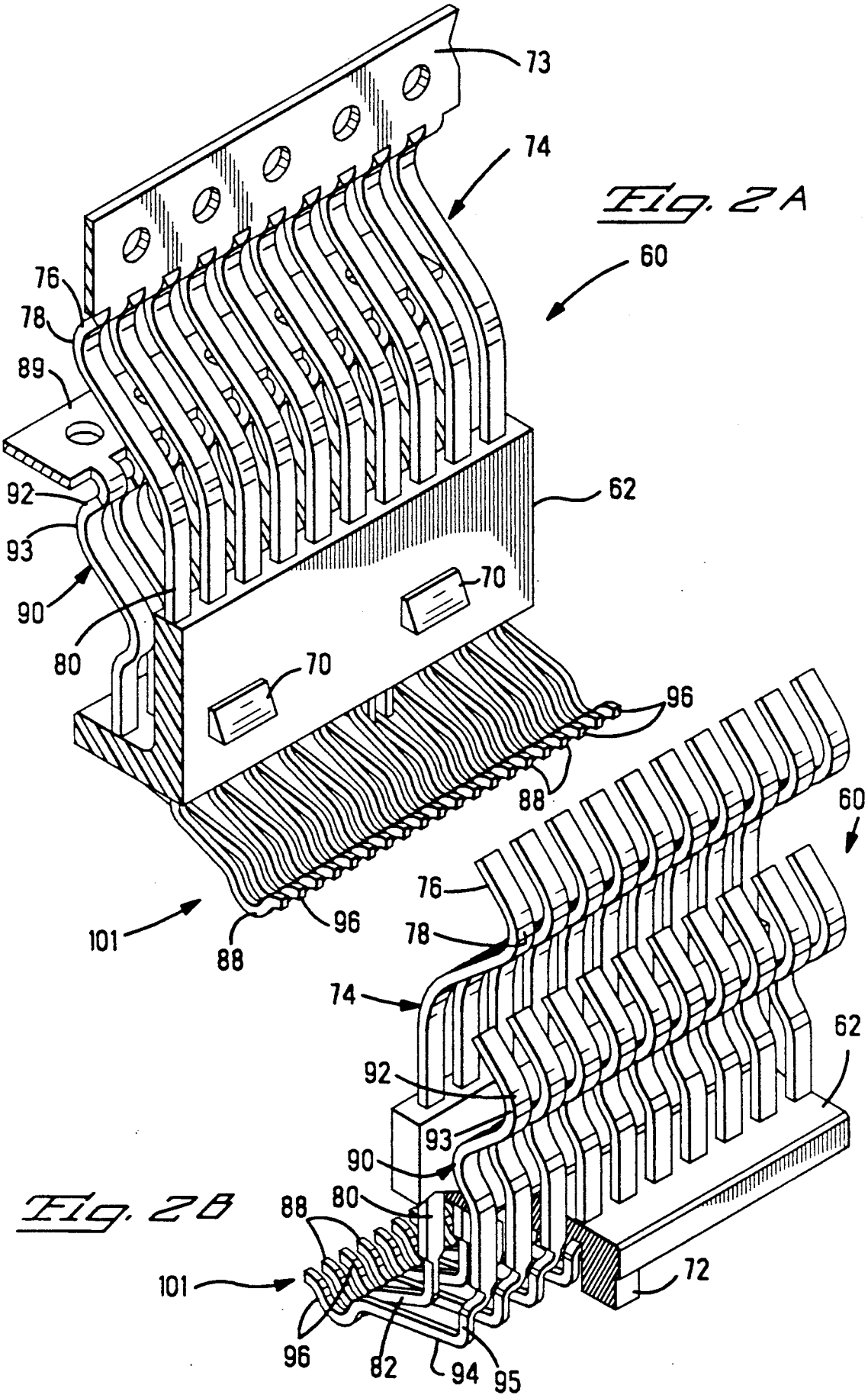
FIGS. 2A and 2B are perspective views of the contact subassemblies of the connector in partial section and vertical orientation, and illustrating steps in making the subassemblies.
Figure 3:
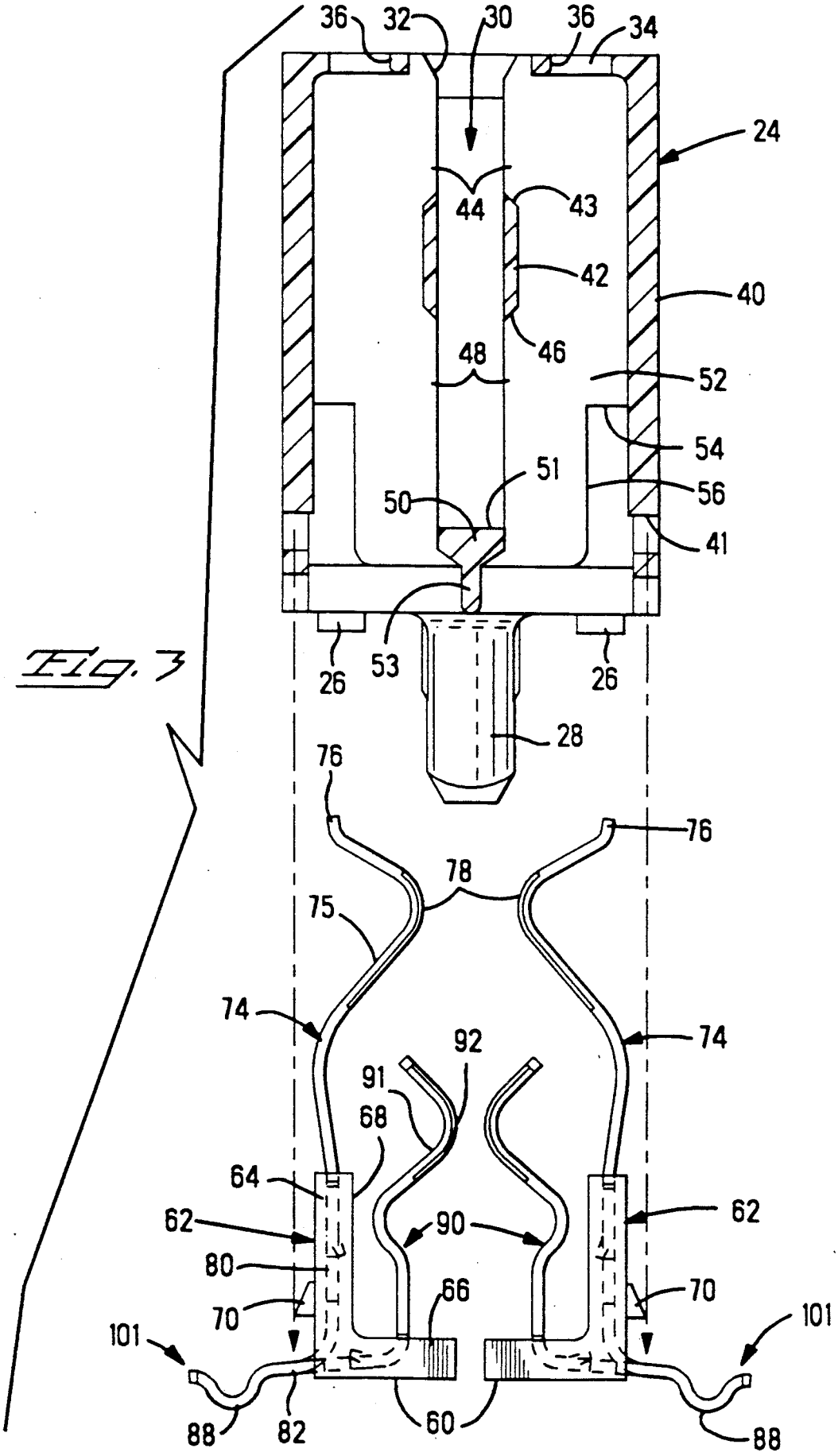
FIG. 3 is an exploded and partially sectioned view of the connector of the invention preparatory to assembly of the several parts thereof.
Figure 4:
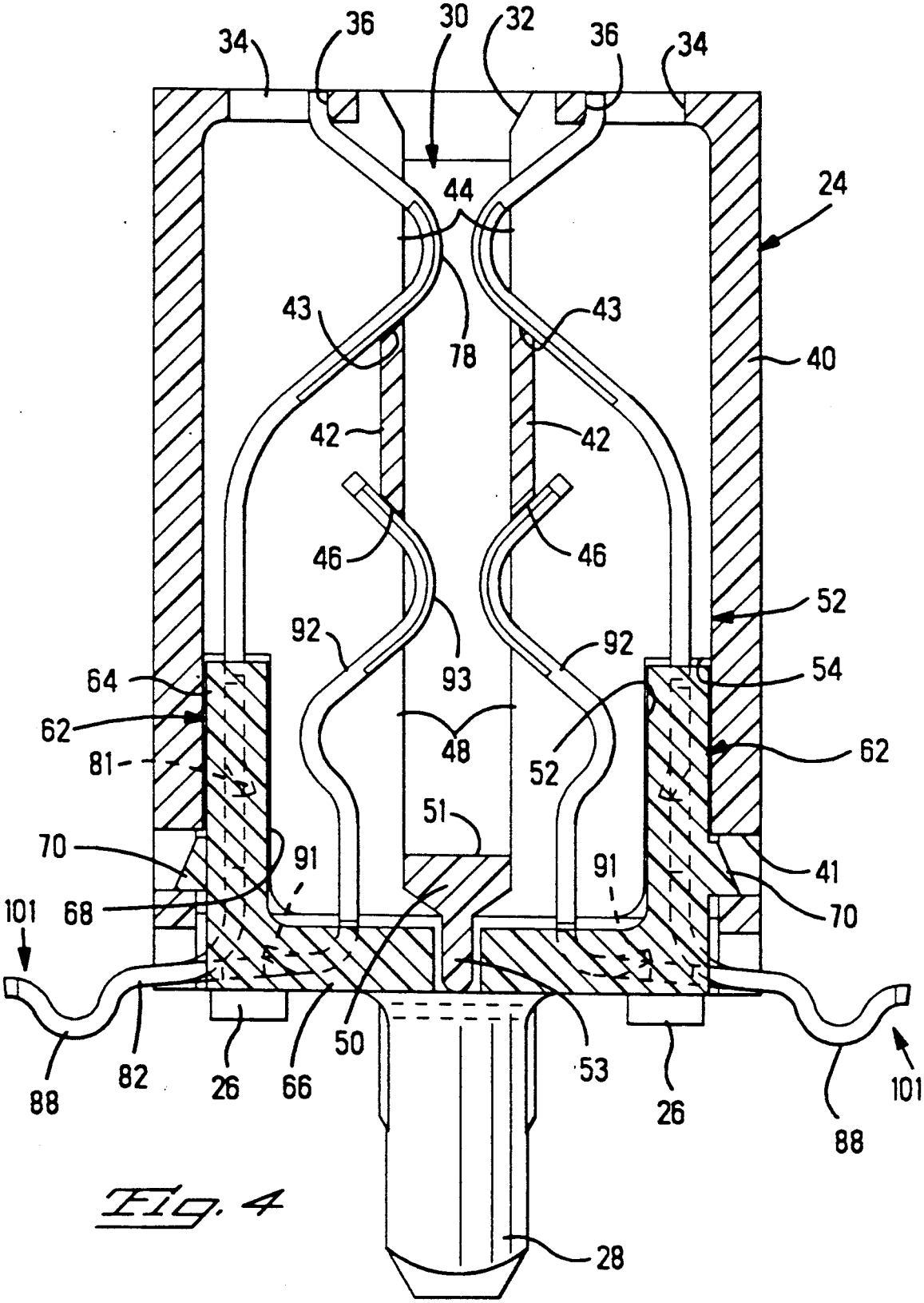
FIG. 4 is a cross-sectional view of the assembled connector of FIG. 3.

The connector 22, in accordance with the invention, is comprised of a multi-part housing including an upper part 24 and a pair 60 of lower subassemblies shown in FIG. 3 to include a respective plastic housings 62 which are L-shaped in cross-section and fit within the upper part in the manner shown in FIG. 4. The upper part of the housing 24 includes a pair of standoffs 26 on the lower face thereof and at least at each end a projection 28, which aligns the connector 22 with the mother board 102 by engaging apertures 104 in the mother board. As can be discerned in FIG. 1, the upper surface of housing 24 includes a board receiving slot 30 extending therealong, slot 30 including a pair of beveled surfaces 32, as also shown in FIGS. 3, 4 and 5. To each side of slot 30 are arrays of apertures 34, each having a transverse edge surface 36 interiorly of the housing surface. The housing 24 includes in the center upper surface thereof a wall 38 preferably beveled at 39 which serves to join the housing sides together for mechanical integrity and provide an engagement for the card slot 18 and the beveled surfaces 20 thereof upon engagement through insertion of the board 12 into the connector housing 24. The connector housing 24 includes on both sides vertical walls 40 having apertures 41 periodically along the lower portion thereof. The connector 22 includes a series of solder tails 88 extending outwardly therefrom along the lower surface thereof and positioned on centers to engage and be terminated to contact pads 106 on the upper surface of board 102. A similar row of contact pads 108 on this surface operates to contact solder tails 88 extending outwardly from the opposite side of the connector 22, such solder tails being shown in FIGS. 2 and 3. The contact pads 106 and 108 are typically interconnected through conductive traces and various laminations buried within board 102 and extending to other pads which connect to other daughter boards and various components and tie the different components together to provide various functions. These paths may also extend to pads on the edge of the board which interconnect the functioning mother board to further input and output signal paths, ground and shielding paths.

Referring now to FIG. 3, an exploded cross-sectional view of the connector 22, the upper housing 24 includes interior walls 42 that extend longitudinally through the housing 24 and define slot 30 therebetween. Walls 42 are joined at the lower surface of housing 24 by bottom wall 50 having surface 51 which defines the lower end of slot 30. Each wall 42 includes upper and lower slots 44, 48 respectively which provide access to slot 30 for first and second contacts 74, 90 respectively. The lower end of slot 44 is defined by surface 43 which acts as a stop, as shown in FIG. 4, to limit inward movement of spring arm 75 first contact 74. The upper end surface 46 of slot 48 acts in a similar manner to limit the inward movement of spring arm 91 of second contact 90. Upon insertion of card 12 into slot 30, surface 50 operates as a stop to position board 12 in downward travel and thus locate the contact pads 14 and 16 thereon relative to contact springs in the manner shown in FIG. 5. The bottom housing wall 50 has a narrowing tip 53 which fits between the lower housing subassemblies 60 in the manner shown in FIG. 4. Each of the slots or apertures 34 leads to a cavity defined by a series of transverse walls 52 and the inner surface of the outer wall 40. Each wall 52 is configured at 54 in the manner shown in FIGS. 3 and 4 to receive an upper part of the lower housing subassemblies. A lower portion of wall 52 provides a bearing surface 56 in the manner shown in FIGS. 3 and 4 to hold the lower subassemblies of the housing in a vertical sense.

As shown in FIG. 3, the housing 22 includes a pair of first and second lower subassemblies 60 comprised of housings 62 having first and second contact members 74, 90 secured therein. Housing 62 is comprised of a plastic body L-shaped in cross-section, including an upstanding or vertical portion 64 and a horizontal portion 66. The interior surface 68 of portion 64 is engaged by the interior wall 52 of the upper housing 24, shown on the right side of the view in FIG. 4. This holds or locks the lower housing portion 62 in a horizontal direction. As can be seen, the outside wall of 62 includes a beveled projection 70 which snaps into the corresponding apertures 41 in the side wall of the housing 24 as shown in FIGS. 1, 3, and 4. As can be seen from FIG. 4, the lower housings 62 and 100 of subassemblies 60 fit up within housing 24 and are latched therein by projections 70 which engage the apertures 41. Each of the housings 62 includes lower standoff projections 72 which operate to limit the downward displacement of the housings relative to the contact members and limit the deflection of such contact members, as shown in FIG. 4.

In the embodiment shown, first and second subassembly 60 are identical. The details of the subassembly can best be understood by referring to FIGS. 2A and 2B. FIG. 2A further illustrates the preferred method of forming a subassembly wherein the respective first and second contact members 74, 90 are stamped and formed and remain attached to respective carrier strip 73, 89 while housing 62 formed around the terminals by insert molding. As can be seen in FIGS. 2A and 2B housing 62 includes a first row of contact members 74 having spring arm sections 75 with upper end 76 curled inwardly to define contact points 78 which engage upper contact pads 16 of a daughter card as shown in FIG. 5. Each of the first contact member 74 includes a lower portion 80 having an arm 82 that extends outwardly and curves downwardly as shown in FIGS. 2A and 2B to define a solder tab 88. Solder tabs 88 preferably include a coating of solder thereon sufficient in thickness to bond the tab to a corresponding tab 108 on the mother board upon application of heat applied thereto. As is also shown in FIGS. 2A and 2B, a row of second contact members 90 are secured in housing 62 and are parallel to the row of first contact members 74. Contact members 90 have spring arms 91 having upper ends 92 curved inwardly to define contact areas or points 93. The lower portions of the second contact members 90 include a bend section 95 and an arm 94 leading to further solder tabs 96. By virtue of the bend section 95, the second contact of the solder tabs 96 of second contact members 90 are caused to be interdigitated with the solder tabs 88 of first contact members 74 to define an array 101 of outwardly extending solder tabs. The solder tabs 88, 96 of all of the first and second contact members 74, 90 thus lie in a common row and in a common plane at their lower ends. This, thereby, connects the two rows of contact pads on each side of the daughter board to one corresponding row of contact pads of the mother board, in essence doubling the density of interconnections for a given linear dimension of the connector and the daughter board relative to the mother board. As can be appreciated, the various contact members of the connector of the invention are on very close centers such as 0.025 inches for the solder tabs and 0.050 inches for each of the rows comprised of contact members 74 and 90.

The corresponding rows of first and second contact areas, 78, 93 of the first and second contact members 74, 90 also lie in essentially a common plane to engage the planar surface of a circuit board inserted into the connector for engagement with corresponding contact pads 14, 16 respectively. The term "essentially a common plane" is meant to mean for contact purposes the plane of the daughter board—in fact, the spring contact arms 75, 91 may be offset slightly to compensate for different cantilevered lengths to achieve equal normal forces of engagement upon insertion of the daughter card.

FIG. 4 shows the assembly of the upper housing 24 and the lower subassemblies 60 with the various contacts in position. Also shown in phantom in FIG. 4 are latches 81 and 91 which may be struck out from the metal of the contact members to provide additional surface area to secure the contact members within the housing portions 64 and 66 respectively. As can be appreciated from FIG. 4, the contact springs are resilient elements which extend within the slot 30 and are deflected outwardly upon the insertion of a circuit board as shown in FIG. 5. In accordance with the invention, the vertical axes of the contact members is such as to cause the contact members to be biased inwardly and rest against the surfaces 36, 43, and 46 as shown with respect to the right-hand contacts in FIG. 4, thus assuring that the contacts will always be in the same relative position when preloaded. Upon insertion of the board 12 as shown in FIG. 5, the contacts are deflected outwardly to define intimate contact points with the conductive pads on the board 12 and define stable low-resistance inter-connections therewith and to the contact elements. The solder tabs 88 are suitably soldered to the pads 106, 108 on the mother board as by infrared or vaporphase heating, which causes a solder reflow, following suitable fluxing of the surfaces. The mounting of the connector 22 on the mother board is designed so that the solder tabs 88 bear against the pads 106, 108 of the mother board sufficiently for effective heat transfer and solder reflow. In accordance with the invention, the contact areas 78 and 93 and the opposite areas on the opposing contacts may be selectively plated with gold over a nickel underplate provided over the entire contact with a solder tabs 88 suitably plated or otherwise coated with a tin lead coating suitable for reflow. The housings are preferably molded of engineering plastic having desirable dielectric qualities with the lower housings either premolded with the contacts inserted in suitable apertures or with the contacts insert-molded on appropriate centers.

In the foregoing description, the terms mother and daughter board have been used in an illustrative manner, the invention contemplating the joining together of circuit boards of various types and constructions. Specific pad centers and contact centers have been mentioned, also in an illustrative sense, it being understood that the invention contemplates relative dimensions as between those which contact one board and another board.

Having now described the invention in terms intended to enable a preferred practice, we set forth what is deemed inventive in the appended claims:

We claim:

1. An electrical connector of a type used to interconnect the contact pads of a mother board having contact pads in a common row on X centers to the contact pads of a daughter board having two rows of contact pads on Y centers, substantially greater than X, said connector including a housing means to receive and position a daughter board on the mother board and further including an array of spaced-apart first and second contact members each having an upper resilient spring contact end and a lower solder tail end, said housing means including means to mount said contact members with the upper contact ends in two rows spaced apart on Y centers to engage the contact pads in two rows on the daughter board said housing means including interior relief and said contact members including the contact ends are held in said relief in a position to allow defection upon insertion of a circuit board and engagement therewith, said solder tail ends being held rigidly in the lower portion of said housing means the solder tail ends of the contacts positioned to be interdigitated in a common row on X centers to engage corresponding contact pads on the mother board.

2. The connector of claim 1 wherein the X dimension is on the order of 0.025 inches or less and the Y dimension is on the order of 0.50 inches or less.

3. The connector of claim 1 wherein the first and second contact members including contact ends arranged in pairs extending in a plane transverse to the length of said housing with the solder tail ends thereof offset to provide interdigitation.

4. The connector of claim 1 wherein said housing means is comprised of an upper housing having means to guide, hold, and position said daughter board therein and lower means including portions holding said contact members on appropriate centers for engagement with said circuit board within said upper housing means and further including means to latch said portions to said upper housing means.

5. The connector of claim 1 wherein said housing means includes lower portions holding said contact members rigidly with the contact ends extending thereabove and with the solder tail ends extending at right angles therefrom and said housing means further includes an upper portion fitted to cover over said contact members and said lower portions and has means locking said upper portion to said mother board.

6. The connector of claim 5 wherein the said upper and lower portions includes latch means enabling said portions to be latched together into an integral assembly.

7. An electrical connector for interconnecting first and second boards including a housing having at least one lower portion having rows of contact members affixed thereto with each contact member having an upper resilient end containing a contact point adapted to engage the contact pad of a first board and a lower end including a solder tail adapted to be soldered to a contact pad on the second board, said contact members being arranged and held by said lower portion to extend in two rows with the ends of the two rows in essentially a common plane spaced apart to engage one side of said first circuit board inserted in said connector, said connector housing further including means adapted to hold said contact ends in a position to allow deflection upon insertion of a circuit board and engagement therewith, said solder tails being held rigidly in said lower portion such that the solder tails are interdigitated to extend in a single row to engage the second board and be soldered to the contact pads thereon, said connector housing having means to engage said second board and hold and position said first board relative thereto and relative to said contact member.

8. The connector of claim 7 wherein the said contact housing includes a pair of lower portions of plastic and insulating material containing contacts therein affixed to extend thereabove and spaced to engage both sides of a circuit board inserted within said connector, each of the said contact members including a solder tail extending through said housing with said tails forming rows positioned to engage contact pads in rows on the second board on opposite side said connector and be soldered thereto.

9. The connector of claim 7 wherein the said contact members have upper ends spaced on Y centers with the lower ends and solder tails spaced on X centers wherein X is substantially less than Y.

* * * * *

UNITED STATES PATENT AND TRADEMARK OFFICE

CERTIFICATE OF CORRECTION

PATENT NO. : 5,052,936

DATED : October 1, 1991

INVENTOR(S) : Donald T. Biechler et al.

It is certified that error appears in the above-indentified patent and that said Letters Patent is hereby corrected as shown below:

TITLE PAGE

After [75] Inventors:, delete "Donald t." and insert --Donald T.--

After [73] Assignee:, delete "AMP Incroporated" and insert --AMP Incorporated--.

In the abstract, line 1 - delete "(b10)" and insert --(10)--.

In the abstract, line 12 - delete the word "anfd" and insert --and--.

Claim 8, column 8, line 15 - delete the word "side" and insert --sides of--.

Signed and Sealed this

Twenty-first Day of June, 1994

*Attest:*

Bruce Lehman

BRUCE LEHMAN

*Attesting Officer*

*Commissioner of Patents and Trademarks*